US006260740B1

(12) United States Patent
Schemeit et al.

(10) Patent No.: US 6,260,740 B1
(45) Date of Patent: Jul. 17, 2001

(54) PROCESS AND DEVICE FOR POURING OF STEEL FROM AN IMMERSION OUTLET

(75) Inventors: Hans-Jürgen Schemeit, Langenfeld; Ulrich Urlau, Moers, both of (DE)

(73) Assignee: Mannesmann AG, Düsseldorf (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,987

(22) PCT Filed: May 29, 1997

(86) PCT No.: PCT/DE97/01093

§ 371 Date: Jan. 12, 1999

§ 102(e) Date: Jan. 12, 1999

(87) PCT Pub. No.: WO97/46344

PCT Pub. Date: Dec. 11, 1997

(30) Foreign Application Priority Data

Jun. 4, 1996 (DE) ..... 196 23 787

(51) Int. Cl.[7] ..... B22D 37/00; B22D 41/50

(52) U.S. Cl. ..... 222/590; 22/594; 22/606; 164/437

(58) Field of Search ..... 222/606, 607, 222/590, 594; 164/437

(56) References Cited

FOREIGN PATENT DOCUMENTS 37 09 188 * 9/1988 (DE) .

WO 96/29166 * 3/1996 (WO) .

OTHER PUBLICATIONS

Patent Abstracts of Japan of JP 62 197252 A, Feb. 1988.*

* cited by examiner

*Primary Examiner*—Scott Kastler
(74) *Attorney, Agent, or Firm*—Cohen, Pontani, Lieberman & Pavane

(57) ABSTRACT

The invention relates to a process and a device for controlling the flow dispersion of a molten metal, in particular steel, which is conveyed from a melt container via a first immersion outlet part which has a polygonal, oval or circular cross-section, and an intermediate member through the second immersion outlet part which has an elongate cross-section, and flows into a stationary mold to produce slabs. The process is characterized by the following steps: (a) the central volume flow is reduced in the intake region of the second outlet part; (b) at the same time the angle of expansion (δ) of the fluid jet is increased to such an extent that the return flow in the lateral region of the intermediate member and the second immersion outlet part is substantially stopped; and (c) when the melt leaves the second immersion outlet part, it flows at a velocity profile with velocity vectors which are smaller in the opening center than the regions of the small faces. The device is characterized in that the region of the central axis (I) of the immersion outlet, the intermediate member (31) and/or the intake (22) of the second immersion outlet part (21) is equipped in such a a manner that the main flow of melt (S) leaving the first immersion outlet part is throttled.

18 Claims, 5 Drawing Sheets

PROCESS AND DEVICE FOR POURING OF STEEL FROM AN IMMERSION OUTLET

BACKGROUND OF THE INVENTION

The invention relates to a process and a device for influencing the flow propagation of a metallic liquid, which, flows in a guided fashion into a stationary permanent mold from a melt container via a first immersion nozzle part, which has a polygonal, oval or circular cross section, and an intermediate part through a second immersion nozzle part, which has an elongated cross section for production slabs.

DESCRIPTION OF THE PRIOR ART

DE 37 09 188 discloses a casting tube for metallurgical vessels which is subdivided into an upper tubular longitudinal section and a lower rectangular longitudinal section, a conical transition being provided between the two longitudinal sections. The rectangular cross section can in this case have a length/width ratio of 20:1 to 80:1.

Provided at the mouth of the immersion nozzle is a transverse web which guides the liquid steel into the lateral mouth openings. In this case, the steel enters the permanent mold with a relatively high kinetic energy. Moreover, the transverse web is subjected to a high degree of wear.

DE 43 20 723 discloses an immersion nozzle which has a tubular shaped refractory brick shape which is connected via a conical constructional element to a lower rectangular shaped refractory brick dipping into the melt. Longitudinal webs are provided in the flow cross section in the lower shaped refractory brick.

In the region of the inlet of the lower rectangular shaped refractory brick, a transverse web is provided which reflects the flow of the melt in the direction of the widening of the flow shaft. This transverse web configured as a baffle disadvantageously causes strong eddies in the melt.

SUMMARY OF THE INVENTION

It is the object of the invention to avoid the disadvantages of the prior art and to create a process and a device relating to an immersion nozzle for guiding metal melts of which minimizes the turbulence in the immersion nozzle itself and in the permanent mold, and simultaneously the depth of penetration of the fed melt into the liquid crater located in the permanent mold.

The invention achieves this object by a process which includes the steps of reducing a central volumetric flow in a second immersion nozzle part of a metallic liquid received from a first immersion nozzle part; increasing an angle of expansion of the liquid jet so that there is no return flow in a lateral region of the second immersion nozzle part and an intermediate part between the first and second immersion nozzle part, and so that a velocity profile of the metallic liquid at the ouput mouth of the second immersion nozzle part is such that velocity vectors are smaller in the center opening of the mouth than in the regions of the narrow sides. The object is also achieved by an immersion nozzle for performing the process.

According to the invention, in the central case of an immersion nozzle whose mouth part dipping into the melt located in the permanent mold has an elongated cross section, the central volumetric flow is reduced in the inlet region of this immersion nozzle part. This reduction in the volumetric flow is caused by throttling the central, which increase the angle of expansion of the liquid jet, specifically to such an extent that there is essentially no return flow into the lateral region of the immersion nozzle part having a longitudinal cross section.

As a consequence of the throttling and simultaneous spreading of the central volumetric flow, the melt flows from this immersion nozzle part with a velocity profile whose velocity vectors are smaller in the opening mouth than in the regions of the narrow sides.

The quantity fed through the immersion nozzle strikes with this set velocity profile against the liquid crater, which is located in the permanent mold and is withdrawn in accordance with the strand withdrawal rate of 1 to 10 m/min, and penetrates at only slight depths into this liquid crater, in accordance with a mixing length of L=0.2 to 4 m.

Owing to the intensive spreading or expansion of the central volumetric flow, the velocity profile in the region of the narrow sides has at the mouth of the immersion nozzle part having an elongated cross section velocity vectors which have components which permit a return flow on the narrow sides of the permanent mold. As a result, an adequate quantity of fresh melt is fed to the bath level in the permanent mold, with a positive influence on the casting powder applied to the surface. Moreover, this melt flows to the center between the immersion nozzle and permanent mold with only a slight bow wave but in an adequate quantity. The flows of melt combine in the middle of the permanent mold and then flow into the liquid crater in the strand withdrawal direction. There, they fill up the volumetric flow, emerging from the second immersion nozzle part, in the mouth center.

The result of this is a virtually flat and overall only shallow depth penetration into the liquid crater, with the advantage that, for example, in the case of a change in quality of the melt only a short mixing length, and thus a short piece of undesired slab quality is produced.

The throttling of the central volumetric flow is achieved by virtue of the fact that the region upstream of the inlet into the immersion nozzle part having a longitudinal cross section, or the inlet itself is configured in a special way. In any case, the free space is kept adequately open, with the result that a defined quantity always flows in the central region of the second immersion nozzle part.

To throttle the central volumetric flow, the wall of the broad side of the intermediate part arranged in the casting direction upstream of the immersion nozzle part with an elongated cross section has a concave bulge. In an advantageous refinement, this bulge is configured in the shape of a quarter hollow sphere. In a further refinement, it has the shape of a tube segment with a prescribable contour.

The throttling is also achieved by a constriction of the free space for the inlet of the immersion nozzle part. This constriction may be effected by flow bodies which are arranged on the broad side of the immersion nozzle part, or by the inward formation of dents.

In an advantageous way, the constriction has a dimension whose width corresponds approximately to the diameter of the upstream tubular immersion nozzle part, and which corresponds in length to 0.2 to 1.2 times its width.

The leading edges and the trailing edges are of sharp-edged construction and in this case have an angle $\beta$ from the leading edge and the inner wall of 90 to 150°. It is possible to combine the shaping of the intermediate part and the constriction. It is proposed in the case of this combination to match the contour of the bulge of the intermediate part to the leading edge of the flow element in the second immersion nozzle part.

BRIEF DESCRIPTION OF THE DRAWINGS

In the drawings, wherein like reference characters denote similar elements throughout the several views:

FIG. 2 shows a cross-section of an immersion nozzle of FIG. 1 and a flow of metallic-liquid there through;

DESCRIPTION OF THE PREFERRED EMBODIMENT

Figure 1:
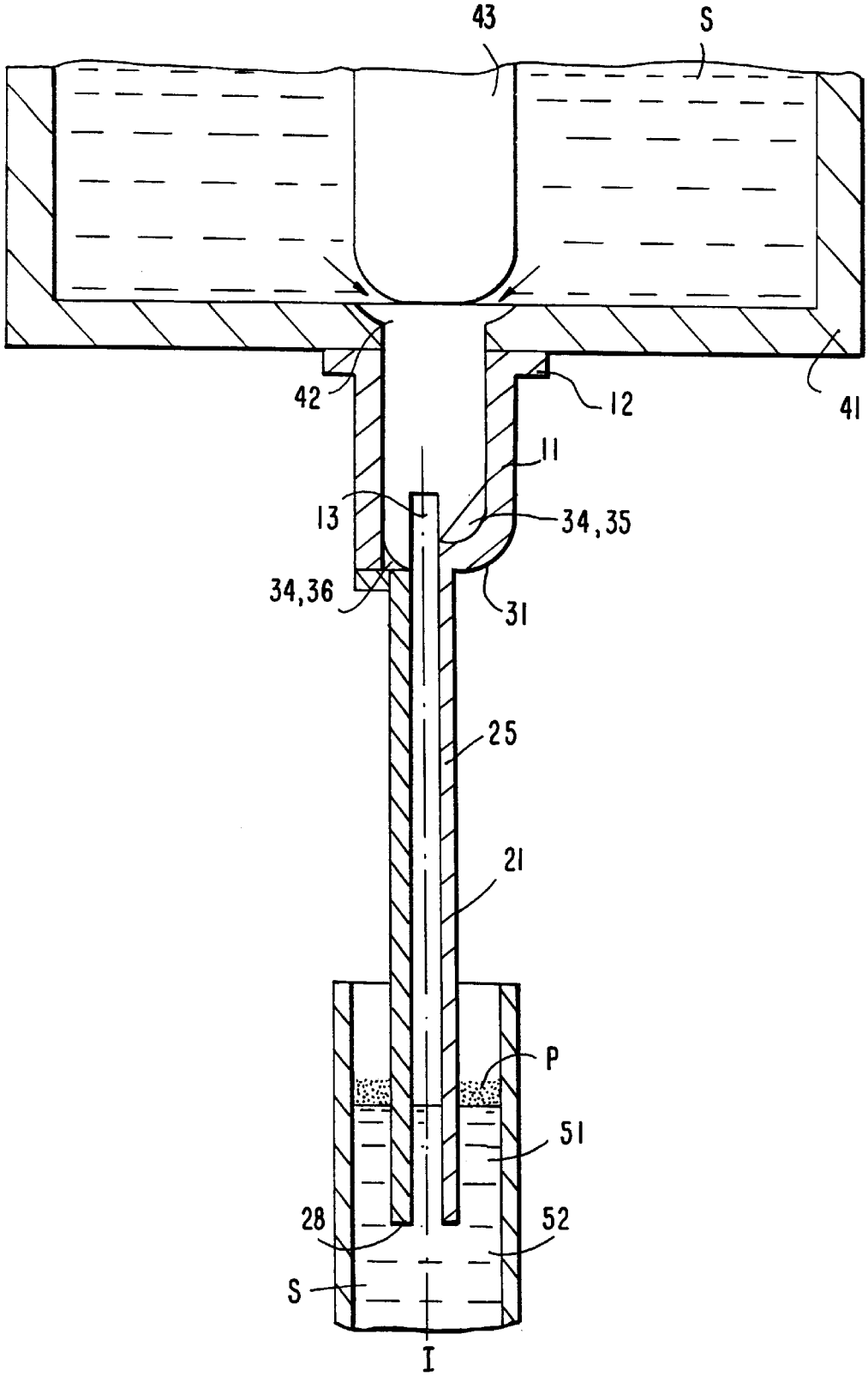
FIG. 1 shows a longitudinal section of an immersion nozzle according to an embodiment of the present invention.
Figure 2:
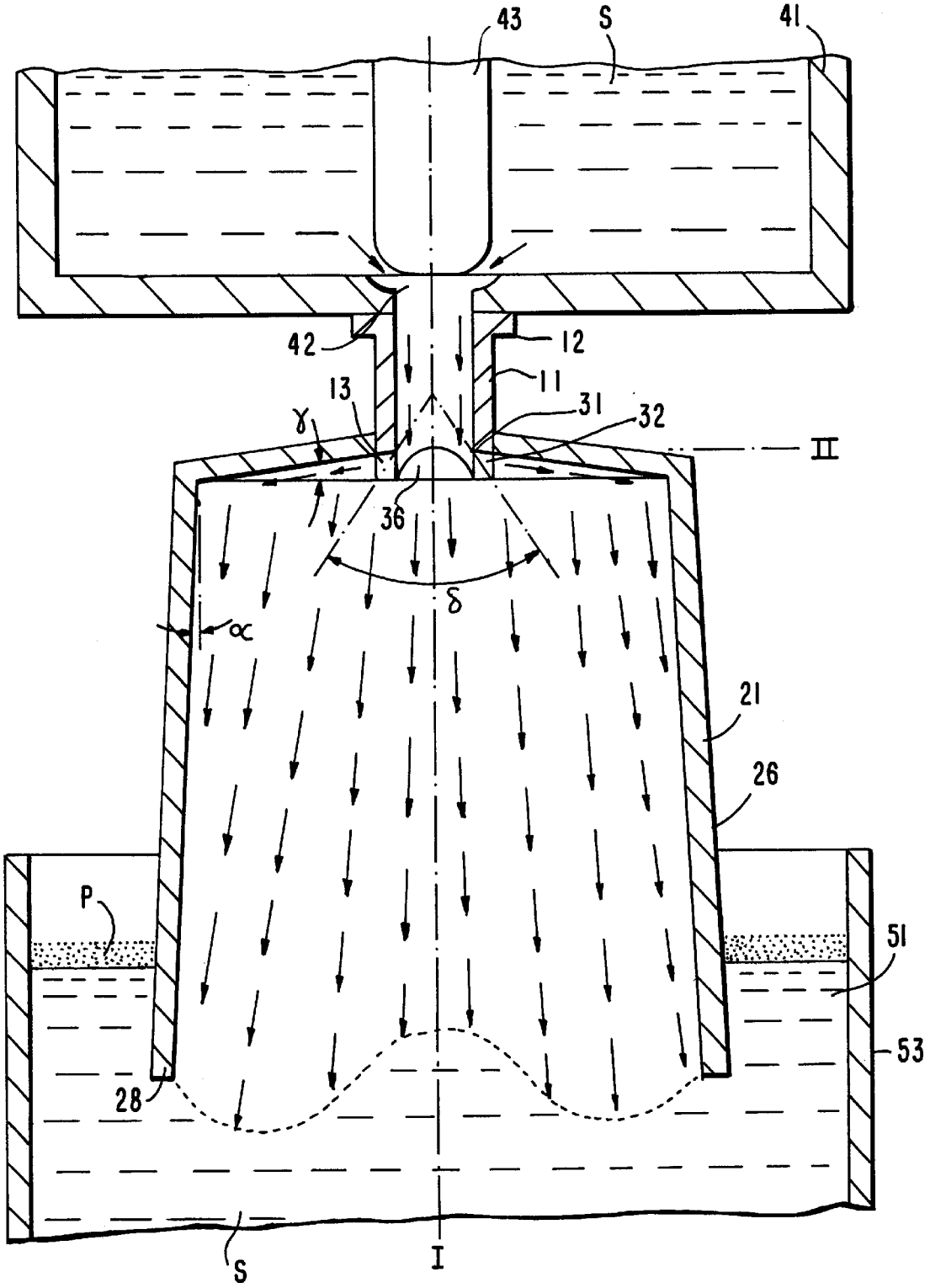
Figure 3:
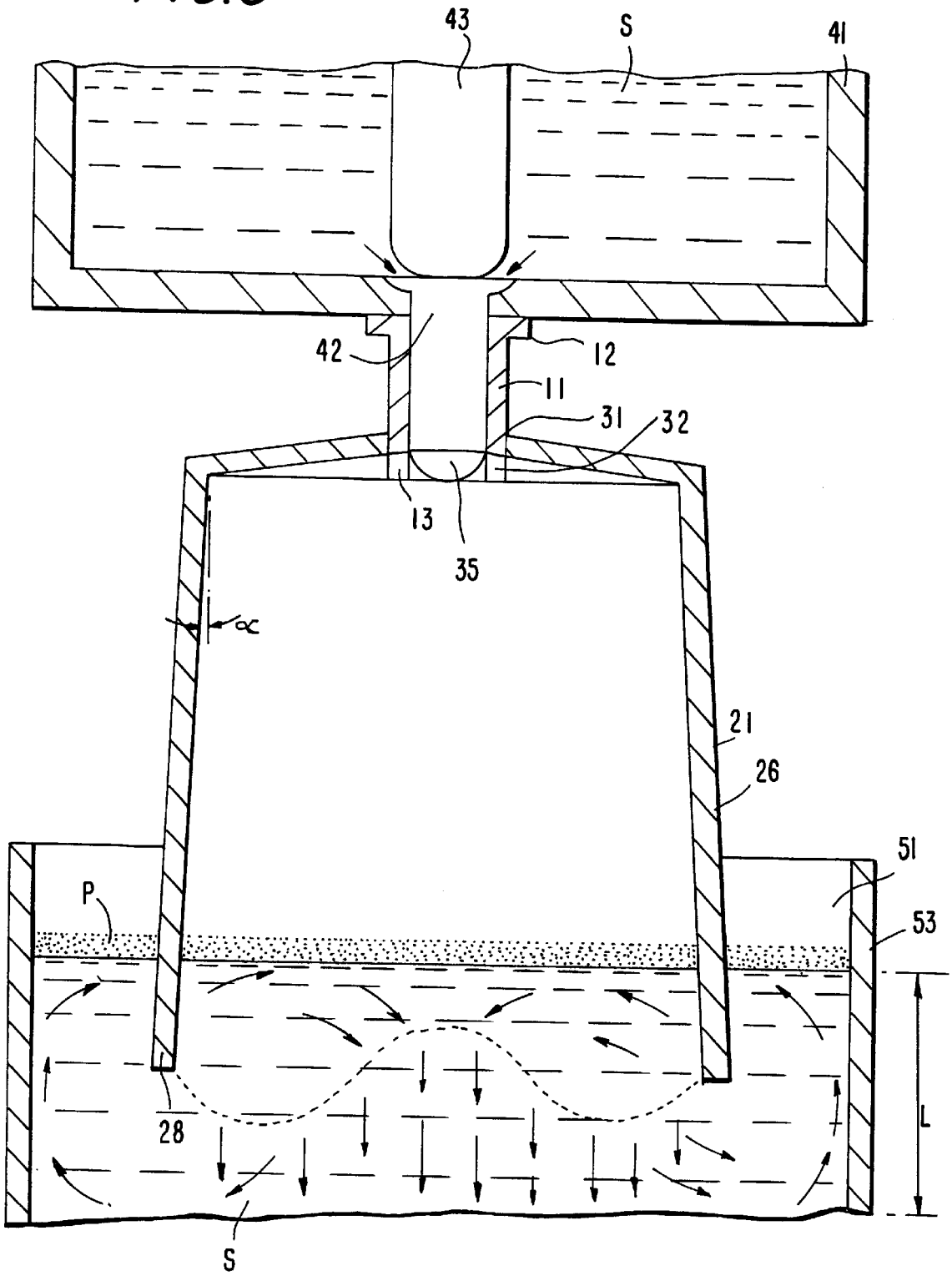
FIG. 3 shows a cross-section of the immersion nozzle of FIG. 1 after the metallic liquid has entered the melt below the immersion nozzle.

FIGS. 1–3 show immersion nozzle which includes a first immersion nozzle part 11, an intermediate part 31 and a second immersion nozzle part 21. A central axis is denoted by I.

Using the same item numbers in all the figures, the first immersion nozzle part 11 is fastened via a flange 12 to a melt vessel 41. An outlet 42 of the melt vessel 41 may be closed by a plug 43. The first immersion nozzle part 11 has a round, oval or else polygonal cross section and is connected via the intermediate part 31 to the second immersion nozzle part 21, which has broad sides 25 which are distinctly larger than the narrow sides 26. The first immersion nozzle part 11 has a slot 13 in the region of the intermediate part 31.

The second immersion nozzle part 21 has a mouth 28 which projects into a permanent mold 51, a mouth 28 dipping into the melt S located in the permanent mold 51. Casting powder P is located on the melt S.

In FIG. 1, the intermediate part 31 has a bulge 34 associated with each broad side 25. In the right-hand part of FIG. 1, a first embodiment of the bulge 34 is as a spherical shape 35, and a second embodiment in the left-hand part of FIG. 1 is a tube segment 36.

On the left-hand side of FIG. 1, the bulge 34 directly adjoins the round immersion nozzle part 11 in the shape of a tube segment 36. With reference to a main axis II, shown in FIG. 2 the tube segment 38 may have a constant radius or else be of parabolic configuration.

A plan view of the bulge 34, represented here as a tube segment 36, is shown in FIG. 2.

A plan view of the bulge 34 is shown in FIG. 3 as a spherical shape 35. Clearly in evidence is the pointed mouth of the quarter hollow sphere 35 in the case of the transition to the broad side 25 of the second immersion nozzle part 21.

The first immersion nozzle part 11, represented here as a tube, opens in the upper part of FIGS. 2 and 3, the slot 13 being located at the mouth. Represented at the start of the slot to both sides of the narrow side 33 is the intermediate part 31, which covers the broad sides 32. The narrow side 33 is inclined at an angle of $\gamma$ to the run-up 22.

The view of the broad side 32 of the intermediate part 31 is represented in FIG. 2. In the central region, the bulge 34 is constructed as a tube segment 36. The bulge 34 is constructed as a quarter hollow sphere 35 in FIG. 3.

The arrows in FIGS. 2 and 3 represent the velocity vectors of the metallic liquid. It is shown in FIG. 2 how the volume and quantity of the melt are reduced in the central region in the flow direction downstream of the throttle element. The melt flows into the second immersion nozzle part 21 in a distinctly expanded fashion with an angle of expansion $\delta$.

In the mouth region of the second immersion nozzle part, the velocity profile in the region of the narrow side walls has a relatively shape which has a low velocity in the mouth center.

In the permanent mold itself (see) (FIG. 3), the velocity vectors have a component which permit a portion of the melt to flow back to the bath surface. Here, they are guided to the middle of the permanent mold 51 and guided up the sides again back down in the direction of strand withdrawal in the center of the permanent mold 51 and also between the broad side 25 of the immersion nozzle 21 and the and broad side 52 of the permanent mold 51.

Figure 5:
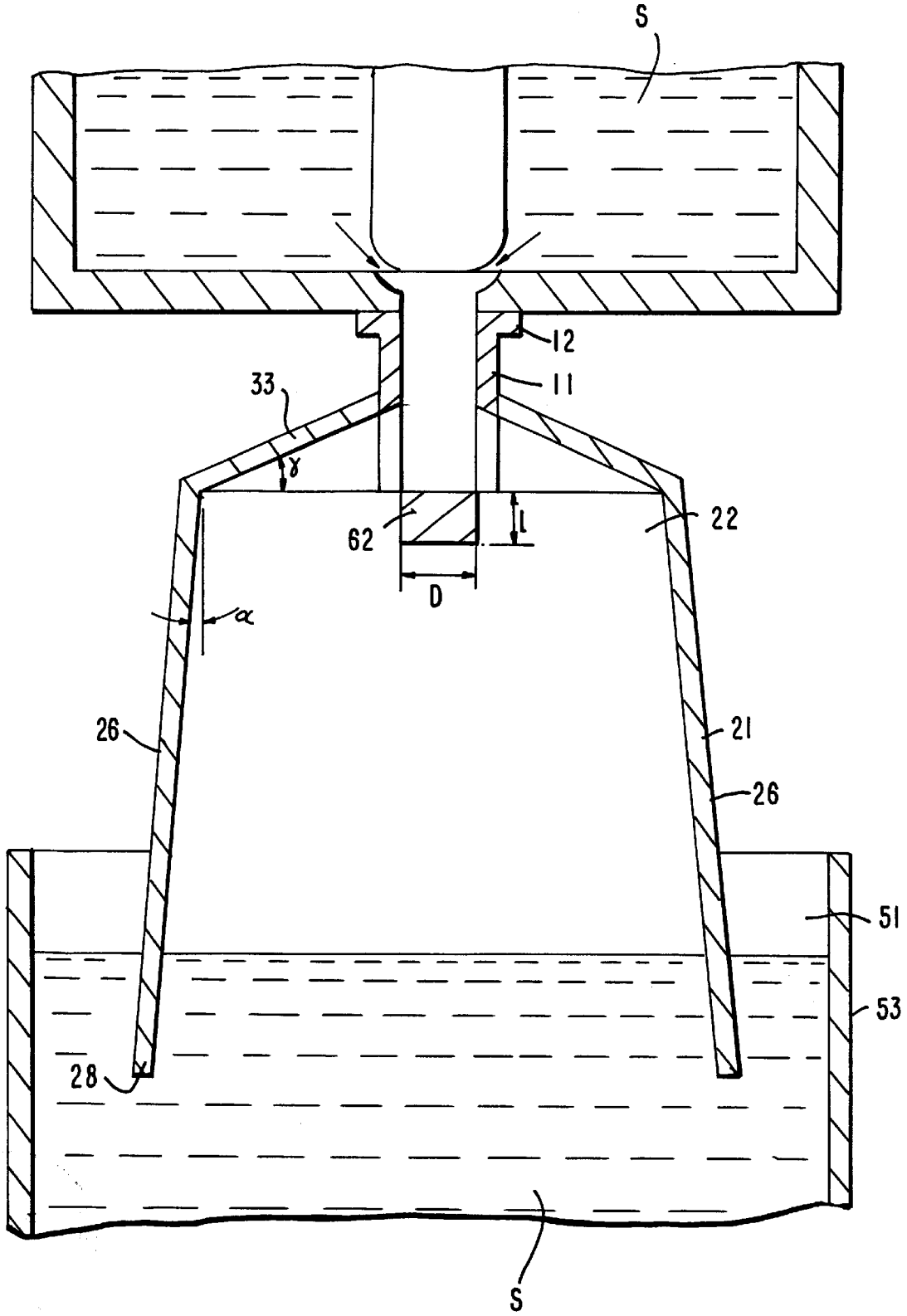
FIG. 5 shows a cross-section of the immersion nozzle of FIG. 4.

The narrow side 21 opens towards the mouth of the second immersion nozzle part with reference to the central axis I in a conical fashion at an angle $\alpha$. This angle $\alpha$ can be clearly greater than the 7° possible in the case of free jets, and can assume a value of up to 15° (see) (FIG. 5).

Figures 4, 4A:
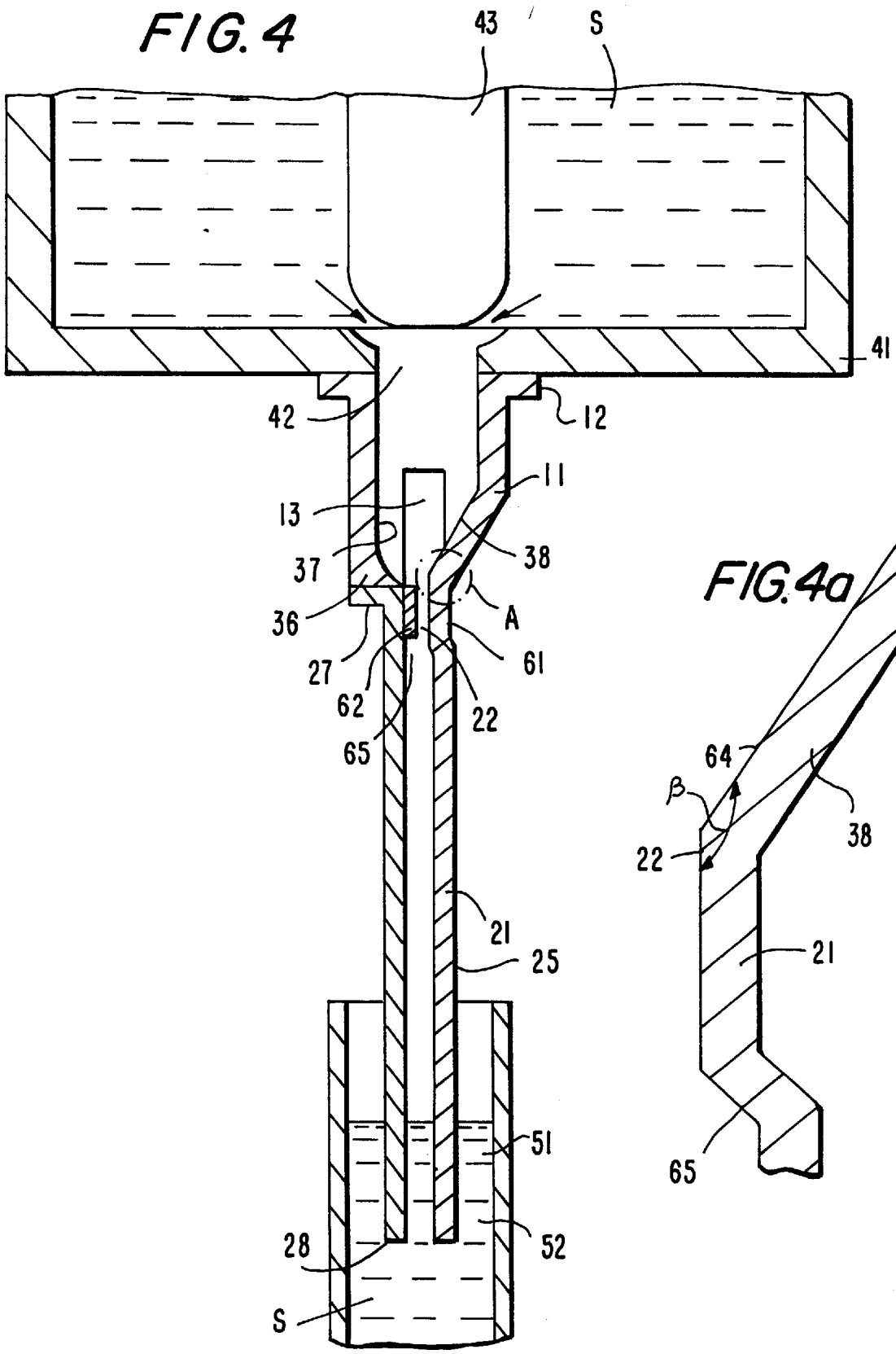
FIG. 4 shows a longitudinal section of an immersion nozzle according to another embodiment of the present invention.
FIG. 4*a* shows a detail A of FIG. 4.

FIG. 4 shows a flow body 62 and a dent 61 in the shadow of the first immersion nozzle 11 in the inlet 22.

In the left-hand side of FIG. 4, the first immersion nozzle part 11 is constructed as a tube whose end is closed by a seal 27. A tube segment 36 is arranged in the inner gore between the seal 27 and the tube 11. The contour 37 is of parabolic configuration. From its mouth, the tube segment strikes the leading edge of a flow body 62.

In the present case, the leading edge 64 is arranged at an angle of 90° to the inner side of the flow body 62. The trailing edge 65 of this flow body 62 likewise has an angle $\beta$ of 90°.

On the right-hand side, the tube 11 is sealed by an inclined surface 38 which is led to the inlet 22 of the second immersion nozzle part 21. The inlet region 22 is constructed as a dent 61. The outer surface of the leading edge 64 has the same angle of inclination as the inclined surface 38.

In the present case, the trailing edge 65 has an angle $\beta$ of approximately 45°. The broad side 25 of the second immersion nozzle part 21 has the same wall thickness as the dent, and springs outwards in the region of the trailing edge 65. In the direction of flow downstream of the flow bodies 61 and 62, the free space 23 is the same size as the whole of the second immersion nozzle part as far as its mouth.

FIG. 5 shows the plan view of the section of the second immersion nozzle 21, represented in FIG. 4, with the constriction 61, 62. Arranged in the shadow of the first immersion nozzle part 11 in the inlet region 22 of the second immersion nozzle part 21 is a flow body 62 having the dimensions of $A=l\times D$. In this case, the length 1 has a value of $l=0.2$ to $1.2\times D$, corresponding to the diameter D of the tubular first immersion nozzle part 11.

Otherwise than in the preceding FIGS. 2 and 3, in FIG. 5 the angle $\gamma$ is in the upper range of the possible bevel of $\gamma=0$ to 40°. The angle $\alpha$ has also been selected to be greater than in FIGS. 2 and 3, it being possible for $\alpha$ to be between 0 to 15°.

What is claimed is:

1. A process for directing a flow of metallic liquid from a melt container to a stationary permanent mold through a first immersion nozzle part, an intermediate part, and a second immersion nozzle part of an immersion nozzle, the second immersion nozzle part having an elongated cross section with broad sides and narrow sides, said process comprising the steps of:

a. reducing a central portion of the flow of metallic liquid at an inlet region of the second immersion nozzle part with respect to the broad sides of the second immersion nozzle part;

b. increasing the angle of expansion of the flow of the metallic liquid at the inlet region for substantially preventing a return flow of the metallic liquid along the narrow sides of the second immersion nozzle part; and c. directing the flow upon leaving the second immersion nozzle part with a velocity profile of flow that is smaller toward the central portion of the second immersion nozzle part and larger toward the narrow sides of the second immersion nozzle part.

2. The process of claim 1, further comprising a step of imparting a velocity component to the flow of liquid exiting the second immersion nozzle that is directed toward the narrow sides of the second immersion nozzle part for ensuring a specific return flow of the melt to a bath level in the permanent mold; and setting a quantity of melt added to the bath of the permanent mold such that the melt penetrates the bath in the permanent mold down to a depth corresponding to a mixing length within the range including 0.2 to 4 m with a strand withdraw rate within the range including 1 to 10 m/min.

3. The process of claim 2, wherein said step of setting a quantity of melt comprises setting a quantity of melt added to the bath of the permanent mold such that the melt penetrates the bath in the permanent mold down to a depth corresponding to a mixing length within the range including 0.2 to 2 m with a strand withdraw rate within the range including 4 to 5 m/min.

4. The process of claim 1 further comprising a step of directing the flow of metallic liquid into the bath in the permanent mold down to a depth corresponding to a mixing length so that velocity vectors of the bath below the mixing length are directed in the same direction and the same speed as the strand withdraw rate from the permanent mold.

5. An immersion nozzle for pouring metallic liquids from a melt container to a bath in a permanent mold, comprising:

a first immersion nozzle part connectable to a melt vessel for receiving the metallic liquids and having a first cross section comprising one of a circular, oval, and polygonal shape;

a second immersion nozzle part having an inlet section and a mouth and having an elongated second cross section with broad sides an narrow sides, wherein an area of said second cross section is equal to or less than and area of said first cross section;

an intermediate part connecting said first immersion nozzle part to said second immersion nozzle part; and a central axis of said immersion nozzle running through said first immersion nozzle part, said second immersion nozzle part and said intermediate part;

said mouth of said second immersion nozzle being insertable into the permanent mold so that said mouth is receivable in the bath; and one of said inlet of said second immersion nozzle part and said intermediate part comprises a configuration projecting toward said central axis for reducing a central portion of the flow of metallic liquid at said inlet region of said second immersion nozzle part with respect to said broad sides of the second immersion nozzle part and increasing an angle of expansion of the flow of the metallic liquid at said inlet region for substantially preventing a return flow of the metallic liquid along said narrow sides of said second innnersion nozzle part.

6. The immersion nozzle of claim 5 , wherein said configuration comprises a concave bulge projecting from one of said broad sides.

7. The immersion nozzle of claim 6, wherein said bulge comprises a quarter hollow sphere.

8. The immersion nozzle of claim 6, wherein said bulge comprises a tube segment having a tube axis parallel with said broad sides of said second immersion nozzle part.

9. The immersion nozzle of claim 8, wherein said tube segment comprises a parabolic contour with a portion of said tube segment having a smaller radius being inclined toward said inlet of said second immersion nozzle part.

10. The immersion nozzle of claim 5, wherein said intermediate part comprises a seal connecting upper edges of said narrow sides to said first immersion nozzle part, said seal being inclined at an angle within the range including 0 to 40 degrees.

11. The immersion nozzle of claim 5, wherein said configuration comprises a constriction between said broad sides in said inlet of said second immersion nozzle part.

12. The immersion nozzle of claim 11, wherein said constriction comprises dents in the broad sides extending into a free space between said broad sides.

13. The immersion nozzle of claim 11, wherein said constriction comprises a flow body extending into a free space between said broad sides.

14. The immersion nozzle of claim 11, wherein said first immersion nozzle part comprises a diameter D and said constriction extends along a direction of flow with a length within the range including 0.2×D to 1.2×D.

15. The immersion nozzle of claim 11, wherein said constriction comprises at least one of a leading edge and a trailing edge with a corner having an angle within the range including 90 to 150 degrees.

16. The immersion nozzle of claim 11, wherein said configuration comprises a bulge and said constriction comprises a leading edge downstream of said bulge.

17. The immersion nozzle of claim 5, wherein said configuration is arranged in a portion of said one of said inlet of said second immersion nozzle part and said intermediate part comprising a first width and wherein a dimension of said configuration along the direction of said first width is smaller than said first width.

18. The immersion nozzle of claim 17, wherein said intermediate part comprises a top connected to said first immersion nozzle part and a bottom connected to said second immersion nozzle part, said configuration being arranged proximate said bottom of said intermediate part.

* * * * *